US005613770A

United States Patent [19]

Chin, Jr. et al.

[11] Patent Number: 5,613,770

[45] Date of Patent: Mar. 25, 1997

[54] APPARATUS FOR SECURING COMPONENT PANELS IN A LIGHTING FIXTURE

[75] Inventors: Paul W. Chin, Jr., Saratoga; Hsing M. Keng, Coronel Palos Verdes Estates, both of Calif.

[73] Assignee: Lite Corporation, Saratoga, Calif.

[21] Appl. No.: 316,126

[22] Filed: Sep. 30, 1994

Related U.S. Application Data

[63] Continuation-in-part of Ser. No. 243,232, May 16, 1994.

[51] Int. Cl.[6] ..... F21V 3/00

[52] U.S. Cl. ..... 362/367; 362/332; 362/433; 362/457; 248/220.1; 312/140

[58] Field of Search ..... 362/332, 360, 362/367, 455, 457, 458, 806, 808, 433; 248/220.1; 312/140, 265.4; 403/170, 217

[56] References Cited

U.S. PATENT DOCUMENTS

| | | | |
|---|---|---|---|
| 379,265 | 3/1888 | Best | 362/367 |
| 1,683,609 | 9/1928 | Dorey et al. | 362/367 |
| 1,818,404 | 8/1931 | Kaufman | 312/140 |
| 2,894,303 | 7/1959 | Armstrong et al. | 312/140 |
| 4,467,405 | 8/1984 | Weber | 362/352 |

*Primary Examiner*—Alan Cariaso

*Attorney, Agent, or Firm*—Christopher M. Tobin; Albert C. Smith

[57] ABSTRACT

A lighting fixture includes one or more corner structures for connecting adjacent panels at their adjacent real or virtual corners or edges at predetermined angles to each other. The corner structures include sockets of which at least one includes a single flange member for adhering support on one side of lighting fixture panels with the other sockets each including at least a single flange member for adhering support on one side of lighting fixture panels. Adjacent ones of the sockets are attached to each other at cantilevered ends or at the bases of the flange limbs, or at combinations thereof. The corner structure can be fabricated from sheet metal by cutting and stamping the corner structure according to a predetermined pattern.

1 Claim, 17 Drawing Sheets

APPARATUS FOR SECURING COMPONENT PANELS IN A LIGHTING FIXTURE

CROSS-REFERENCE TO RELATED APPLICATIONS

This application is a continuation-in-part patent application of a pending patent application filed on May 16, 1994 with the same inventorship, entitled "Apparatus and Method for Securing Component Panels in a Tiered Lighting Fixture," Ser. No., 08/243,232. This patent application is expressly incorporated herein by reference in its entirety.

TECHNICAL FIELD

This invention relates to methods and apparatus for securing lighting fixture component panels, and more particularly to methods and arrangements for securing component panels of a lighting fixture irrespective of relative panel size and panel perimeter configuration and panel arrangement.

BACKGROUND OF THE INVENTION

Lighting fixture component panels may be flattened or curved pieces of material including glass which may have straight or curved edges and which may be wholly transparent or wholly or partially translucent or subject to varying temporal or permanent levels of opacity. The component panels may be, for example, triangular or rectangular or hexagonal or oval or generally irregular pieces of glass of the same or dissimilar sizes, which are completely transparent. In a functional arrangement, adjacent edges or tangent or nearly tangent points or corners or regions of the panels may be assembled proximately to each other.

One known type of lighting fixture includes bound glass (BG) configurations. The term lighting fixtures means lighting appliances generally which are structurally fixed in place on a mounting surface or mobile or free-standing appliance or portable lighting. The bound glass configuration provides a U-shaped metallic channel around the edges of each panel section to be joined into a cooperative lighting arrangement. The U-shaped channel is often not seamless. Rather the U-shaped channel is formed into a bound shape which joins the ends of the U-shaped channel at a corner of a component glass panel. However, some kinds of bound glass fixtures have experienced difficulties. Securing the ends of the U-shaped channels reliably, for example, using soldering techniques is difficult. Soldered connections at the ends of the U-shaped channels and between adjacent channels tend to break from time to time and are generally time-consuming to prepare properly.

It may be desirable to secure lighting fixture component panels with minimal structural complexity in reduced hardware structures, irrespective of panel size and edge configuration and panel arrangement.

SUMMARY OF THE INVENTION

The present invention is accordingly directed toward securing lighting fixture components panels having a plurality of real or virtual corners or edges at joinder points near adjacent corners or tangent or nearly tangent points or regions or edges of the panels, and toward particular construction methods for making and assembling such structures. According to the present invention, corner structures are employed to join and secure selected fixture component panels at their respective real or virtual corners or edges or at such edges or corners and adjacent edges of contiguous panels. Joinder of the corner structures and the panel sections can be accomplished using selected glue, solder or epoxy. The present invention is additionally directed toward tiered and non-tiered lighting structures having panels which are interconnected by specialized connectors which are fastened to the panel corner or edge at or near a tangent point or region or edge at the location of a real or virtual panel corner or edge.

The panels can be connected in parallel and series arrangements of panels, and combinations of panels may form a closed or ring-like segment. Ring-like means in the general configuration or shape of a ring, including rings with gaps. Panels or combinations of panels may form tiers which are generally cylindrical.

According to the present invention, a lighting fixture includes a plurality of structures for connecting panels at predetermined configurations with respect to each other. The lighting fixture further includes any number of corner and pseudo-corner (e.g., including virtual corner) structures connecting panels in one construct at predetermined angles to one or more panels in an adjacent panel combination. Further, each of the corner structures includes at least first and second sockets and specifically contains as many sockets as contiguous panels being connected together. Further, at least one socket includes a single flange member for connection to a selected side of the panel being connected and each of the other sockets includes at least a single flange member for connection to a selected side of the panel being connected. In particular, the corner structures have at least one socket of L-shaped or J-shaped cross section.

Further according to the present invention, corner structures comprise at least a single asymmetrical socket structure having a base for panel edge abutment and an arm or limb for secure transverse placement and adhesive fastening of the panel being connected. In cross section, the socket construction according to the present invention may be L-shaped in an "L" configuration of first and second limbs each having base and cantilevered ends. The angle of base connection of the limbs is selectable. The corner structures can have multiple parts, each part comprising a unilateral or multi-lateral socket structure, but having at least a single unilateral or asymmetrical socket structure. According to another embodiment, the unilateral socket structure has another partial arm or limb, to convert the L-configuration into a J-configuration or a U-configuration, depending upon the upward length of the J-configuration socket limb relative to the base of the sockets. Further, according to the present invention, the corner structure can include a two part or three part configuration including sockets for connecting contiguous panels at real and virtual corners and edges. According to these configurations of the present invention, a selected panel is connected at a virtual corner or edge to the corner structure, near the real corner or edge of a contiguous panel. It is additionally within the scope of the present invention for the corner structure to connect virtual corners or edges of contiguous panels. Further within the scope of the present invention is a corner structure including first and second unilateral sockets respectively connected to each other at selected cantilevered ends or at selected base ends of the socket parts. Alternatively, the first and second unilateral sockets can be connected at the base of one socket and at a selected cantilevered end of the other socket. Further, the corner structure can be direct or offset with a straight (i.e., substantially flat) offset or extension member, or with an offset or extension member connected to cantilevered socket limbs with a significant surface bend.

DETAILED DESCRIPTION OF THE PREFERRED EMBODIMENTS

Figure 1:
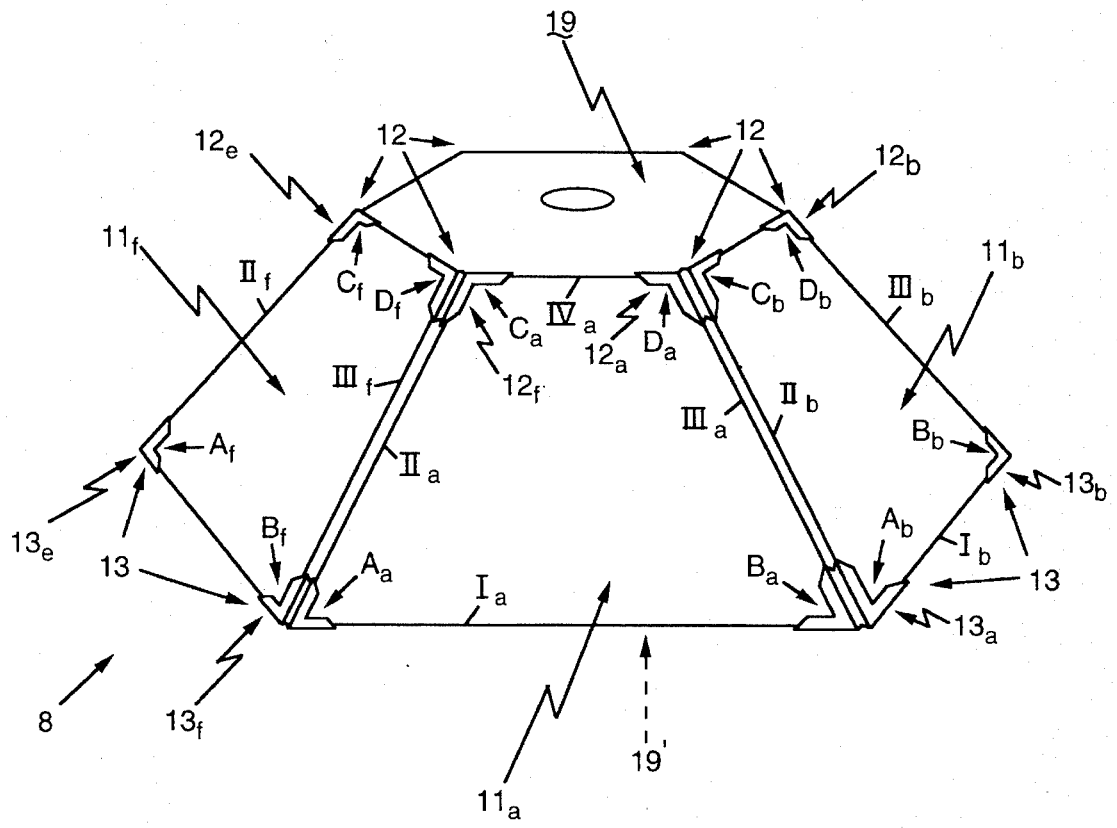
FIG. 1 shows a perspective view of a lighting fixture in accordance with one embodiment of the present invention.

FIG. 1 shows a perspective view of a lighting fixture 8 in accordance with one embodiment of the present invention. This embodiment includes a single-tiered, six-sided, hexagonal polyhedral structure including six panels respectively 11*a*–11*f* (panels 11*c*–11*e* on the backside of lighting fixture 8 not shown) and corner structures 12 and 13. Panels 11*a*–11*f* are collectively referred to as panels 11 for convenience. The panels may have selected optical and physical properties including selected degrees of transparency and translucency, as well as shape, pigment, color, and opacity. Panels 11 are shown in the shape of truncated isosceles triangles to form symmetrical trapezoids. Each of the panels 11 shown has four corners and four edges, respectively designated by capital letters A–D for the corners, and I–IV for the edges. The edge and corner designations indicated may be provided with subscripts to indicate a particular corner of a particular panel, e.g., Ca for corner C of panel 11*a*, or IIIa for edge III of panel 11*a*. Alternatively, the corners and edges may be referred to generally without use of subscripts when the general case of the corner or edge is in discussion. Panels 11 of lighting fixture 8 are connected at their respective corners A–D with corner structures 12 and 13. Corner structures 12 are also referred to particularly as corner structures 12*a*–12*f* in FIG. 1 (corner structures 12*c* and 12*d* on the backside of lighting fixture 8 not being shown). Corner structures 13 are also referred to particularly as corner structures 13*a*–13*f* in FIG. 1 (corner structures 13*c* and 13*d* on the backside of lighting fixture 8 not being shown).

Lighting fixture 8 in FIG. 1 further includes a flat plate 19 which is connected to corner structures 12 as by soldering, glue, or epoxy, for example. Such solder, glue, or epoxy may be substituted by another suitable material, medium, or method which is effective for ensuring adhesive or adherent joinder between corner structure and panel. A preferred material is Duro MasterMend extra strength, quick set epoxy made by Loctite Corporation of Cleveland, Ohio. Flat plate 19 may be hexagonal in shape and may be fabricated of metal or glass or other suitable material. Lighting fixture 8 may further include a flat plate 19' (shown in phantom) which is connected to corner structures 13 as by soldering, for example. Flat plates 19 and 19' may be hexagonal in shape and may be fabricated of a suitable metal or glass or other suitable material. The central portions of plates 19 and 19' may be cut or hollowed out, leaving the plates in the shape or form of a ring or frame, for example. Alternatively, wire-type frames or rings with or without radial wire spokes connected to a central ring or hub (for attaching conventional lighting components) may also be used. As can be seen with reference to FIG. 1, flat plate 19' would be larger in area than flat plate 19, to accommodate the separation of corner structures 13 being separated from each other by greater distances than are corner structures 12. Flat plate 19' may be provided with substantially vertical support indirectly or directly from flat plate 19 through support rods, tubes, or ribs as will be discussed in greater detail below in connection with another embodiment of the invention. Such vertical weight bearing members can extend along the substantially vertical junctions of adjacent panels between upper and lower plates, or can extend substantially vertically inside or outside the hexagonal polyhedral structure, as more fully described later herein. In this illustrated embodiment, as well as in alternative embodiments of the present invention, as discussed below, it should be noted that the panels 11*a*–11*f* which are illustrated and described as generally flat panels may also have curved surfaces and non-straight edges within the scope of the present invention.

Figure 2:
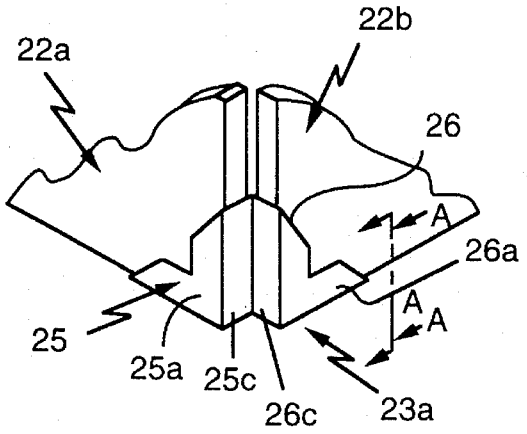
FIG. 2 shows first and second portions of adjacent panels connected at adjacent corners with a corner structure according to the present invention which features L-shaped sockets.
Figure 3:
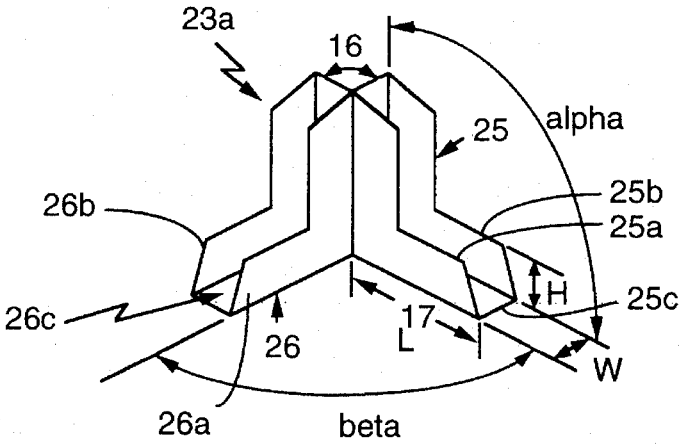
FIG. 3 shows a perspective view of details of the corner structure of FIG. 2 including L-shaped sockets.
Figure 4:
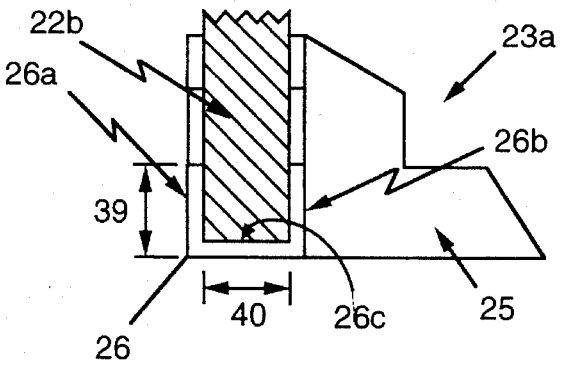
FIG. 4 shows a partial cross-section A of details in FIG. 2 illustrating how panel sections are received, secured, supported, and held in place in the bottom trough and sides of the L-shaped socket of a corner structure according to the present invention.

FIG. 2 shows first and second portions of adjacent panels 22*a* and 22*b* connected at adjacent corners Ba and Ab with a corner structure 23*a* according to the present invention. FIG. 3 shows a perspective view of details of the corner structure 23*a* of FIG. 2 including first and second L-shaped (in side profile) sockets 25 and 26. Angle alpha is an example of a panel corner angle. Angle beta is an example of a planar angle of inclination between adjacent panels. FIG. 4 shows a partial cross-section A of details in FIG. 2 illustrating how panel sections 22*a* and 22*b* are received, secured, supported, and held in place in the bottom trough and sides of L-shaped sockets, according to the present invention. Each of sockets 25 and 26 includes first and second flanges respectively 25*a*, 25*b*, and 26*a* and 26*b*. Further, each of sockets 25 and 26 includes a central base portion respectively 25*c* and 26*c*. Central base portions 25*c* and 26*c* include a generally vertical element and a generally horizontal element, against which the corners of panel sections 22*a* and 22*b* may bear when inserted between respective flanges 25*a*, 25*b*, or 26*a*, 26*b*, as the case may be. So positioned, the respective flanges straddle the corners of a panel in that the flanges are disposed on opposite sides of a panel. Each socket can be made separately, and then the two sockets can be attached, as by soldering at an edge thereof, for example. Alternatively, the front and rear portions of the sockets may be separately manufactured. Then, the central portions may be made and the front and rear portions may be joined as flanges to the central portions.

Further, the combined corner sockets may be manufactured in one piece such as by one-piece moldings using conventional injection molding or die casting techniques or by stamping or by extrusion, for example. The U-shaped cross-section of socket 26 of corner structure 23*a* is detailed in FIG. 4. The U-shaped cross section of socket 26 has a central section 26*c* of inside depth 39 and inside width 40. U-shaped cross section of socket 26 further includes sides including front and back portions of flanges 26*a* and 26*b*. As noted above, sockets 25, 26 may be L-shaped. In particular, each of flange sides 25*a*, 25*b*, and 26*a*, 26*b*, may be L-shaped including vertical and horizontal limbs of substantially equal lengths according to one embodiment of the invention. The vertical and horizontal limbs are joined at a proximal end, and each limb has side and distal edges. The distal and side edges may be variously angled from the limb axis. According to one embodiment, the distal edge angle with respect to the limb axis is 90 degrees. In other words, the distal edge is perpendicular to the limb axis. The limb axis may be parallel to the side edges. According to another embodiment, the distal edge may be fabricated at 45 degrees or at other selected angles from the limb axis. The corner structures shown in FIGS. 2–4 are called doublets, because they connect only two corners of adjacent panels. The height of an L-shaped limb is indicated in FIG. 3 by a capital "H," the width between limbs, by capital "W," and the limb length, by capital "L." According to another embodiment of the invention, the opposite side flange members can be of different heights, so that the U-shaped cross section can be a "non-symmetrical" J-shaped cross section with sides of different heights. According to another embodiment of the invention, one side flange member can be of zero height, so that the U-shaped cross section effectively becomes an L-shaped cross section with only one side and bottom trough central base portion.

Figure 5:
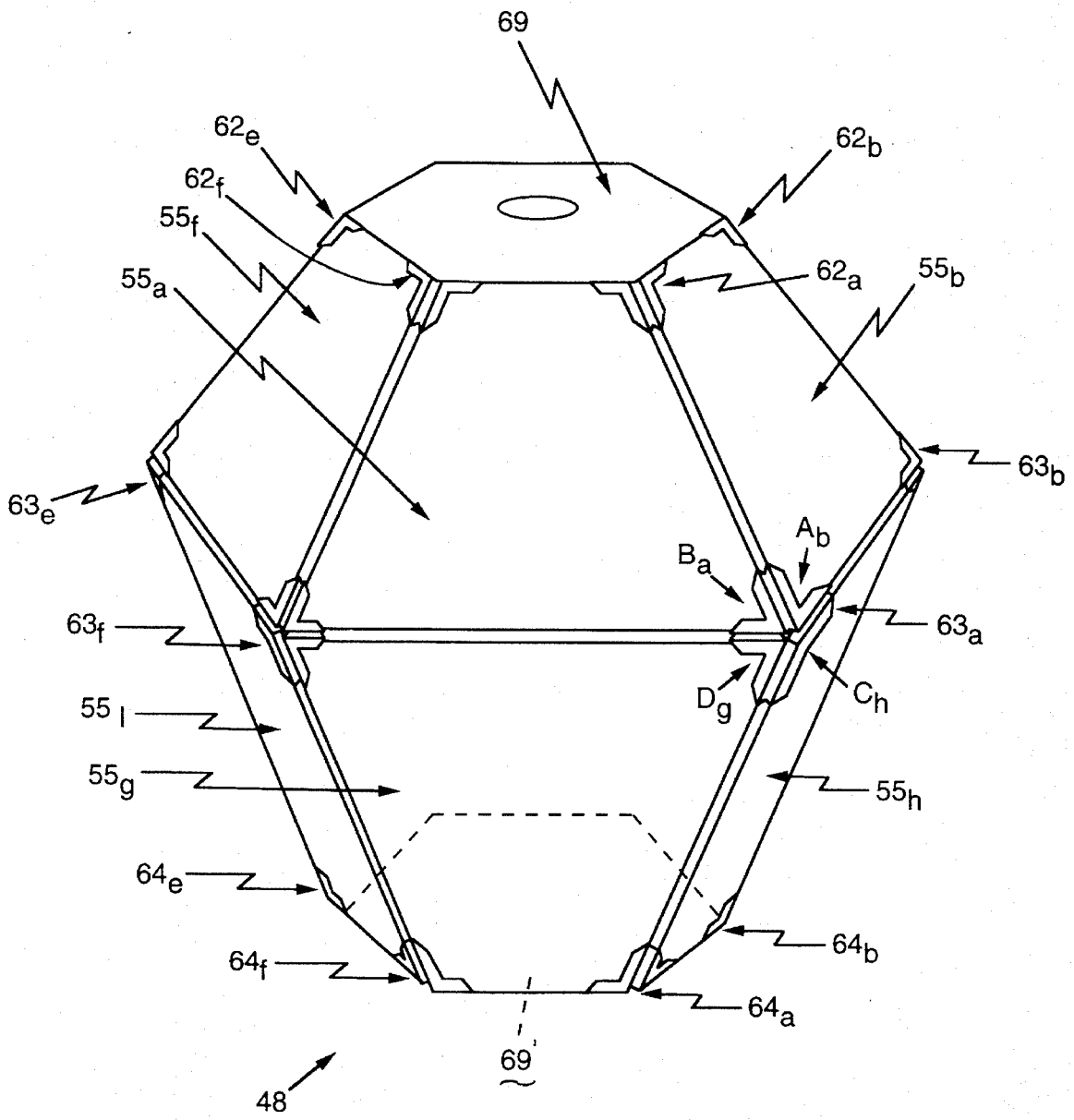
FIG. 5 shows a side perspective view of a lighting fixture in accordance with another embodiment of the invention.

FIG. 5 shows a lighting fixture 48 in accordance with another embodiment of the invention, taken in side perspective view. Lighting fixture 48 according to the illustrated embodiment of the present invention is a double-tiered, six sided, hexagonal polyhedral arrangement of twelve panels 55. The embodiment of the invention shown is directed toward a twelve panel arrangement, the panels respectively 55*a*–55*l* (panels 55*c*–55*e* and 55*i*–55*k* on the backside of lighting fixture 48 not shown). Panels 55*a*–55*l* are collectively referred to as panels 55 for convenience. Panels 55 are shown in the shape of truncated isosceles triangles or trapezoids. Each of the panels 55 shown has four corners and four edges, these respectively designated by capital letters A–D for the corners, and Roman numerals I–IV for the edges. The edge and corner designations indicated may be provided with subscripts to indicate a particular corner of a particular panel, e.g., Ca for corner C of panel 55*a*, or III*a* for edge III of panel 55*a*. Alternatively, the corner and edges may be referred to generally without use of subscripts when the general case of the corner or edge is in discussion. Panels of lighting fixture 48 are connected at their respective corners A–D with corner structures 62, 63, and 64. Corner structures 62 are also referred to particularly as corner structures 62*a*–62*f*, in accordance with FIG. 5 (corner structures 62*c* and 62*d* on the backside of lighting fixture 48 are not shown). Corner structures 63 are also referred to particularly as corner structures 63*a*–63*f*, in accordance with FIG. 5 (corner structures 63*c* and 63*d* on the backside of lighting fixture 48 are not shown). Corner structures 64 are also referred to particularly as corner structures 64*a*–64*f*, in accordance with FIG. 5 (corner structures 64*c* and 64*d* on the backside of lighting fixture 48 are not shown).

Lighting fixture 48 in FIG. 5 further includes a flat plate 69 which is connected to corner structures 62, for example, by soldering, or glue, or epoxy. Lighting fixture 48 may further include a flat plate 69' which is connected to corner structures 64, for example, by soldering, or glue or epoxy. Flat plates 69 and 69' may be hexagonal in shape and may be fabricated of metal or glass or other structurally suitable material. The central portions of plates 69 and 69' may be cut or hollowed out, leaving the plates in the shape or form of a ring or frame, for example. Alternatively, wire-type frames or rings with or without radial wire spokes connected to a central ring or hub may also be used. As can be seen with reference to FIG. 5, flat plate 69' may be different in area than flat plate 69, to accommodate the separation of corner structures 64 by different distances than for corner structures 62. Flat plate 69' may be provided with substantially vertical support directly or indirectly from flat plate 69 through support rods, tubes, or ribs as will be discussed in greater detail below in connection with another embodiment of the invention. Such substantially vertical weight bearing members can extend along the substantially vertical junctions of adjacent panels. Alternatively, such weight bearing members or struts can extend substantially vertically internally or externally of the panels and the associated hexagonal polyhedral structure, as more fully described later herein.

Figure 6:
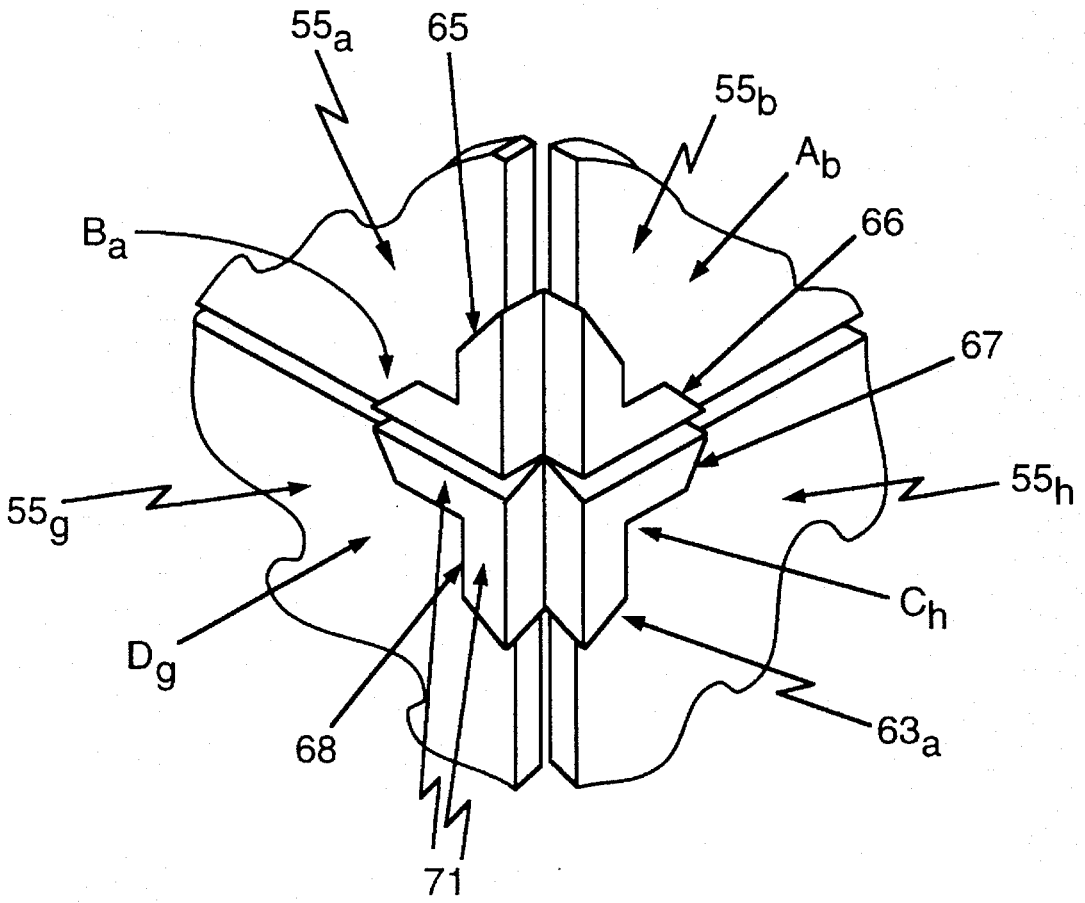
FIG. 6 shows first through fourth portions of adjacent panels connected at adjacent corners with a corner structure according to a selected embodiment of the present invention which features L-shaped sockets.
Figure 7:
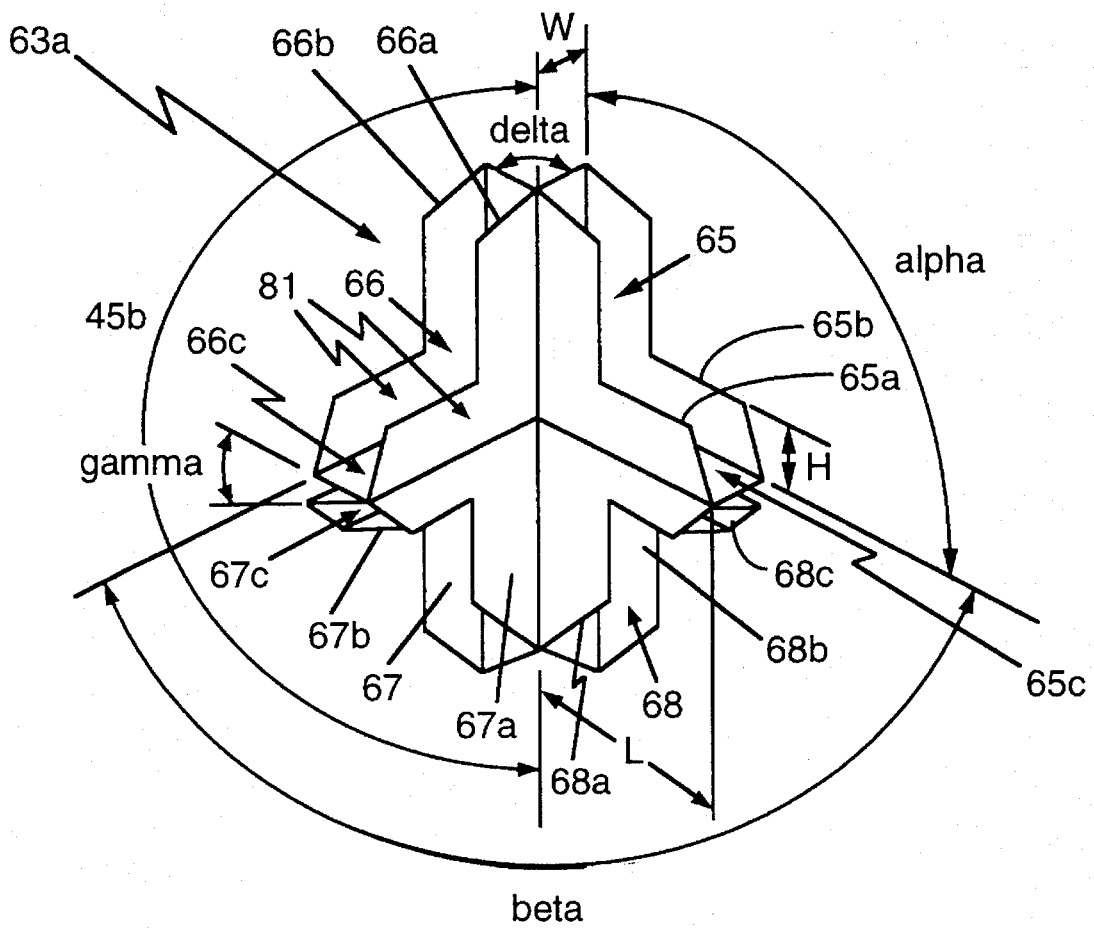
FIG. 7 shows a perspective view of details of the corner structure of FIG. 6 including L-shaped sockets.

FIG. 6 shows first through fourth portions of adjacent panels respectively 55*a*, 55*b*, 55*g*, and 55*h* connected at adjacent respective corners Ba, Ab, Dg, and Ch, with a corner structure 63*a* according to the present invention. Corner structures 63*a*–63*f* of FIG. 6 include first through fourth L-shaped sockets 65–68, according to one embodiment of the present invention. Each of sockets 65–68 includes first and second flanges, these being respectively designated in pairs as flanges 65*a*, 65*b*; 66*a*, 66*b*; 67*a*, 67*b*; and 68*a* and 68*b*. Further, each of sockets 65–68 includes a central base portion. These central base portions are designated respectively as central base portions 65*c*, 66*c*, 67*c*, and 68*c*. Each socket can be made separately, and then the four sockets can be attached, for example, by soldering them together at adjacent edges thereof. According to another embodiment, the front portions of the sockets including flanges 65*a*–68*a* and part of the central base portions 65*c*–68*c* can be separately manufactured from the rear portions including flanges 65*b*–68*b* and part of the central base portions 65*c*–68*c*. Then, the front and rear portions may be joined as flanges to each other. Alternatively, the combined corner sockets may be manufactured in one piece such as by one-piece moldings using conventional injection molding or die-casting techniques or by stamping or by extrusion, for example. As seen in FIG. 7 sockets 65–68 are U-shaped in cross-section, according to one embodiment of the present invention. Other cross sectional shapes, such as L-shapes, J-shapes, V-shapes, or H-shapes, without limitation, are useful as well, provided suitable adaptations of shapes of the panels which they hold are made. The V-shaped cross sectional embodiment is particularly suited to accommodate beveled panel edges.

FIG. 7 shows a perspective view of details of corner structure 63*a* of FIG. 6 including L-shaped sockets 65–68. For example, socket 66 of corner structure 63*a* further includes side flanges 66*a* and 66*b*. As noted above, sockets 65–68 may be L-shaped. In particular, each of flanges 65*a*, 65*b*, 66*a*, 66*b*, 67*a*, 67*b*, 68*a*, and 68*b* may be L-shaped. The shape of the L includes vertical and horizontal limbs, the vertical limb and the horizontal limbs being equally long, according to one version of the invention. The vertical and horizontal limbs are joined at a proximal end, and each limb has side and distal edges. The distal and side edges may be variously angled from the limb axis. According to one embodiment, the distal edge angle with respect to the limb axis is 90 degrees. In other words, the distal edge is perpendicular to the limb axis. The limb axis may be parallel to the side edges. According to another embodiment, the distal edge may be fabricated at 45 degrees or at other suitable angles relative to the limb axis. The corner structures shown in FIGS. 6 and 7 may be referred to as quadruples, because they connect four corners of adjacent panels. The height of an L-shaped limb is indicated in FIG. 7 by a capital "H," the width between limbs, by capital "W," and the limb length, by capital "L." According to another embodiment of the invention, the opposite side flange members can be of different heights, so that the U-shaped cross section can be "non-symmetrical" J-shaped cross section with sides of different heights. According to another embodiment of the invention, one side flange member can be of zero height, so that the U-shaped cross section effectively becomes an L-shaped cross section with only one side and bottom trough central base portion. Angle beta is an example of a planar angle of inclination between adjacent panel planes, as reflected in the respective angular dispositions of the adjacent corner structure sockets. Angle alpha is a corner apex angle of a particular panel shown at the indicated corner thereof.

Figure 8:
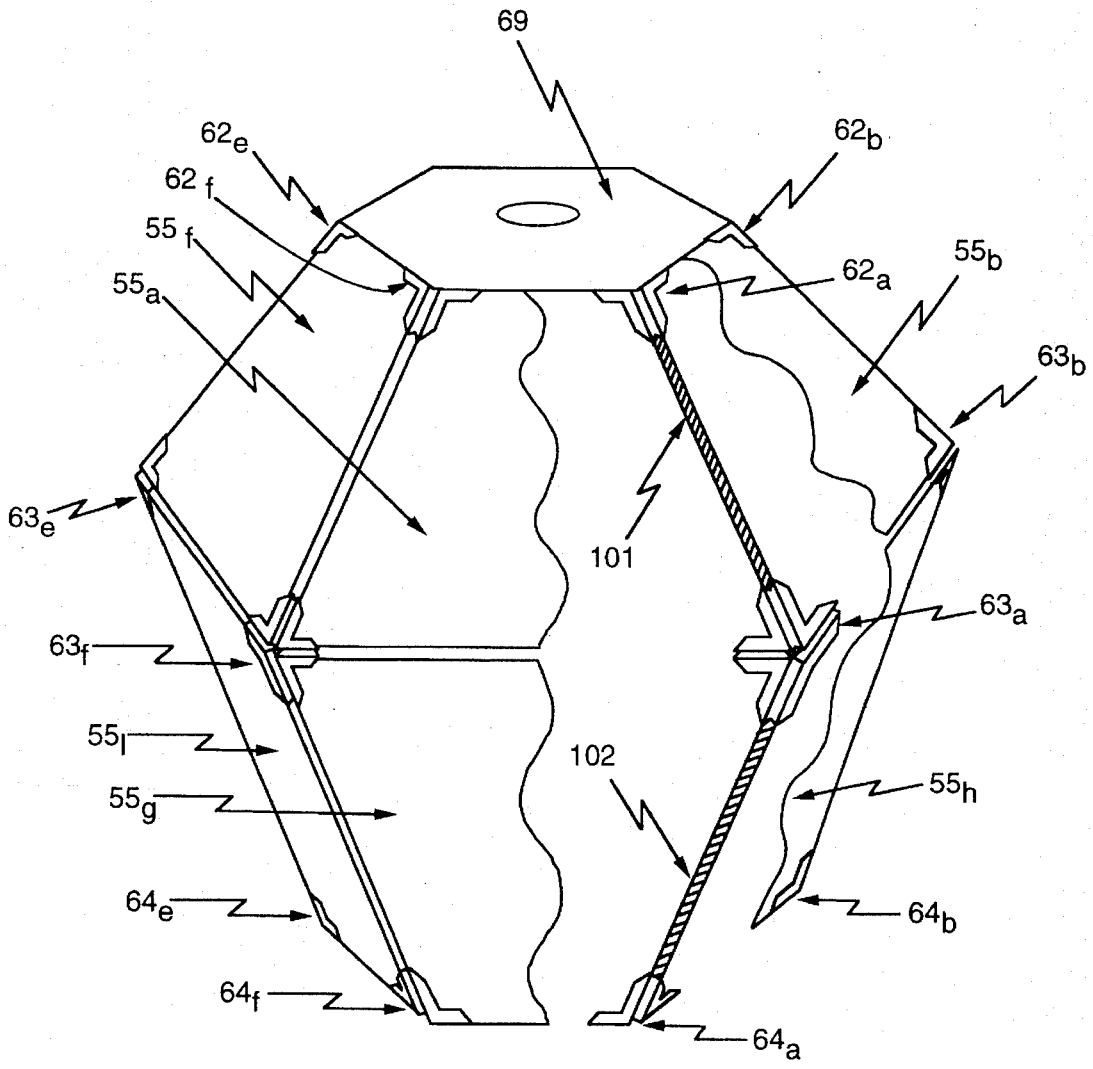
FIG. 8 shows a lighting fixture in accordance with another embodiment of the invention, taken in side perspective view.

FIG. 8 shows lighting fixture 48 with portions of panels 55*a*, 55*b*, 55*g*, and 55*h* broken away to show a version of the invention in which light fixture 48 includes additional support structures 101 and 102 which may be rods, ribs, or tubes, for example and without limitation, configured to extend along the vertical junctions of pairs of horizontally adjacent panels of light fixture 48. Support structures including distal ends 101 and 102 according to one embodiment may be a single unitary piece or rod bent along the lengths to align with the edges of the adjacent panels, or may be separate pieces 101 and 102 that are joined at corner structure 63*a*. The distal ends 101 and 102 are attached either to corner structures 62 and 64 or to plates or rings 69 and 69'. Such support structures can alternatively extend along the vertical junctions of adjacent panels or may span independently thereof along any path between panels, plates, or rings 69, 69'. Alternatively, such support structures can extend between upper and lower plates or rings substantially vertically internally or externally of the panels and the associated hexagonal polyhedral structure.

Figure 9:
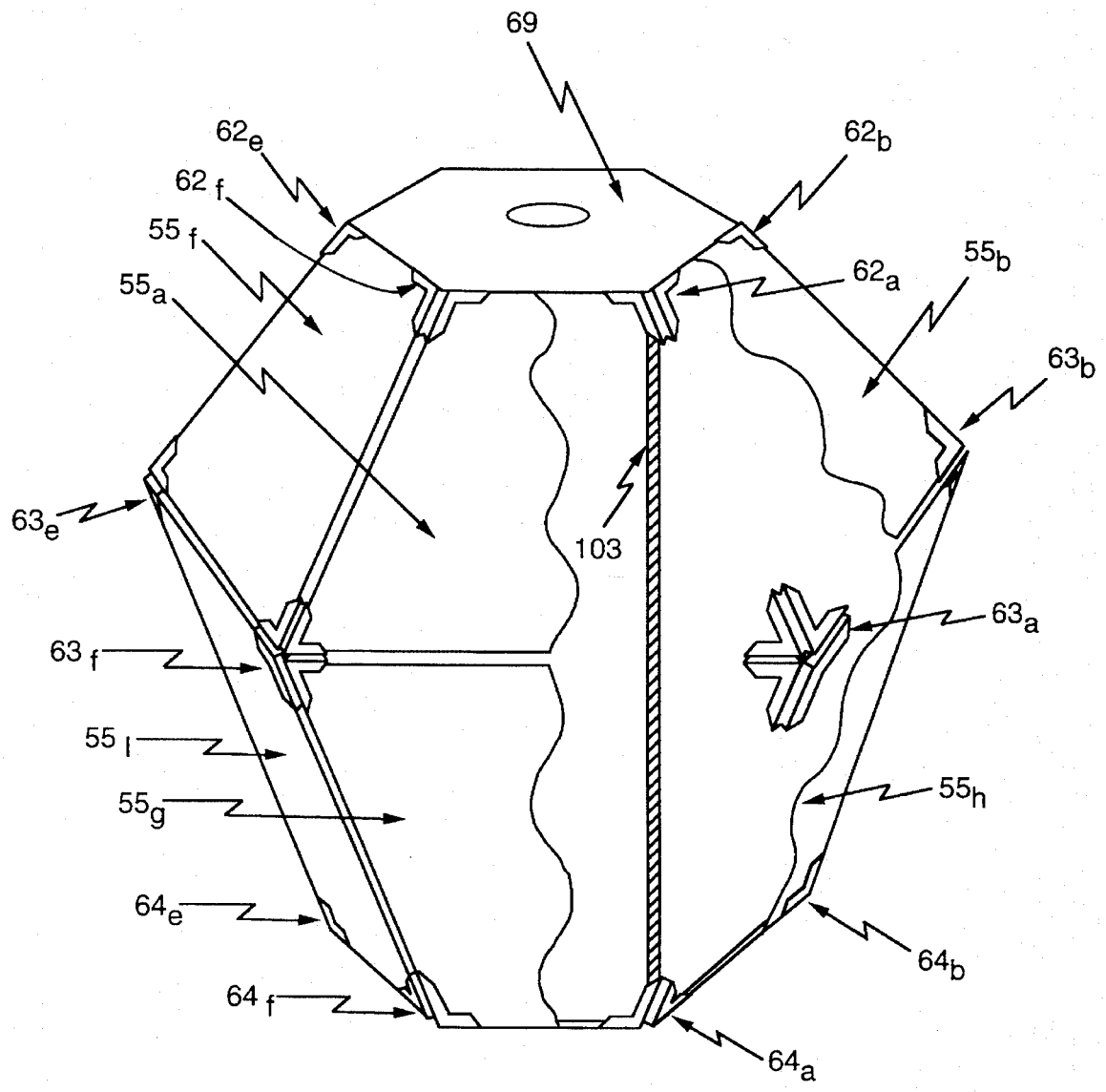
FIG. 9 shows a side perspective view of a lighting fixture in accordance with another embodiment of the invention.

FIG. 9 shows a version of lighting fixture 48 in which portions of panels 55*a*, 55*b*, 55*g* and 55*h* are shown broken away. This embodiment version of lighting fixture 48 employs support structure 103 including a single or plural number of bars or members extending directly from top to bottom of lighting fixture 48 and connecting either corner structures 62 and 64 directly, or plates or rings 69 and 69' directly, or some combination thereof such as for example corner structure 62 with plate or ring 69' or corner structure 64 with plate or ring 69. A tube, strut, or other elongated member may be employed in lieu of the bar indicated to support the lower tier or tiers of panels positioned above plate or ring 69'.

Figure 10:
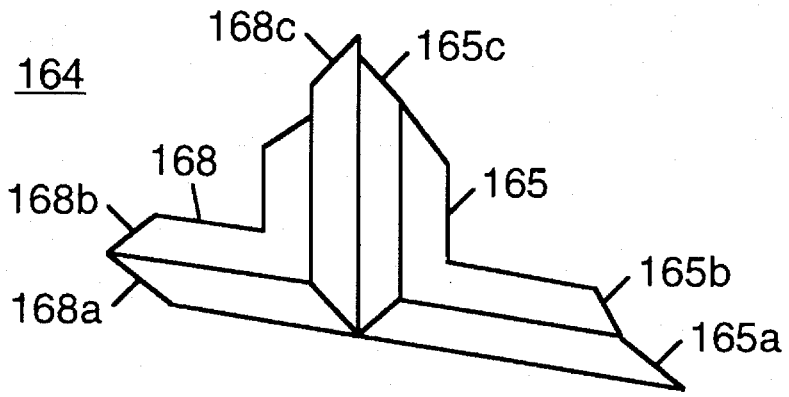
FIG. 10 shows a two-part (i.e., "doublet") corner structure according to a selected embodiment of the present invention which features L-shaped socket cross sections with selectable angles for the limbs of the L-shaped socket.

FIG. 10 shows a two-part (i.e., "doublet") corner structure 164 according to an embodiment of the present invention which features L-shaped socket cross sections with selectable angles for the limbs of first and second structure portions respectively 165 and 168. Structure portion 165 includes first, second, and third surfaces 165*a*, 165*b*, and 16*c* respectively. Such a corner structure construction permits convenient stamping from sheet metal. Surfaces 165*c* and 165*a* have angled connections with surface 165*b* which according to one embodiment of the present invention are substantially equal in angular deviation from surface 165*b*. Structure portion 168 includes first, second, and third surfaces 168*a*, 168*b*, and 168*c* respectively. Surfaces 168*c* and 168*a* have angled connections with surface 168*b* which according to one embodiment of the present invention are substantially equal in angular deviation from surface 168*b*.

The process of manufacturing a corner structure according to the present invention includes selection of a desired corner structure design and preparation of a suitable pattern, mold, or model. According to one embodiment of the present invention, the pattern, mold, or model is then applied to fabricate metal material into the desired end product. The metal material used in the fabrication can be sheet metal, for example, according to one embodiment of the present invention. This sheet metal can first be cut or clipped into the selected form or shape in a flat, two-dimensional intermediate form. Next, according to one embodiment, the two-dimensional intermediate workpiece is stamped or rolled or otherwise formed or fashioned into the desired end product shape as indicated for example in the Figures of the drawing of the present invention herein. According to this method and process, a single, unitary, and integral corner structure is produced.

Figure 11:
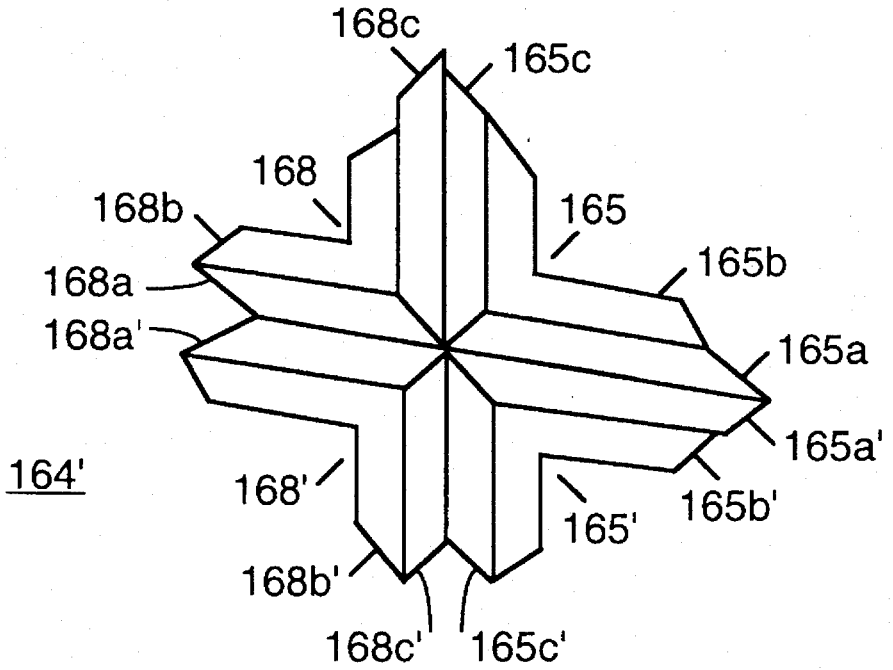
FIG. 11 shows a four-part (i.e., "quartet") corner structure according to a selected embodiment of the present invention which features L-shaped socket cross sections with selectable angles for the limbs of the L-shaped socket.

FIG. 11 shows a four-part (i.e., "quartet") corner structure 164' according to a selected embodiment of the present invention which features L-shaped socket cross sections with selectable angles for the limbs of structure portions respectively 165, 168, 165', and 168'. Structure portion 165 includes first, second, and third surfaces 165*a*, 165*b*, and 165*c* respectively. Surfaces 165*c* and 165*a* have angled connections with surface 165*b* which according to one embodiment of the present invention are substantially equal in angular deviation from surface 165*b*. Structure portion 165' includes first, second, and third surfaces 165*a'*, 165*b'*, and 165*c'*respectively. Surfaces 165*c'* and 165*a'* have angled connections with surface 165*b'* which according to one embodiment of the present invention are substantially equal in angular deviation from surface 165*b'*. Structure portion 168 includes first, second, and third surfaces 168*a*, 168*b*, and 168*c* respectively. Surfaces 168*c* and 168*a* have angled connections with surface 168*b* which according to one embodiment of the present invention are substantially equal in angular deviation from surface 168*b*. Structure portion 168' includes first, second, and third surfaces 168*a'*, 168*b'*, and 168*c'* respectively. Surfaces 168*c'*and 168*a'* have angled connections with surface 168*b'* which according to one embodiment of the present invention are substantially equal in angular deviation from surface 168*b'*.

Figure 12:
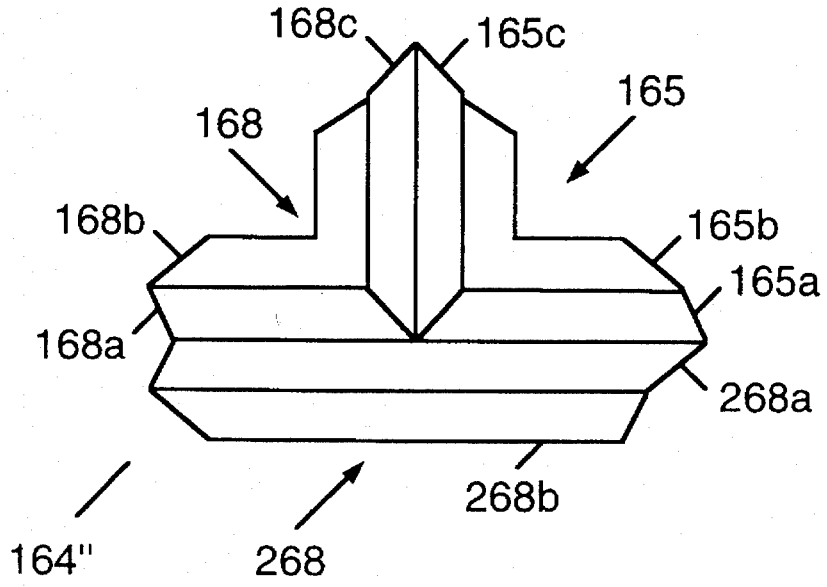
FIG. 12 shows a three-part (i.e., "triplet") corner structure for two real and one virtual corner or edge according to a selected embodiment of the present invention which features L-shaped socket cross sections with selectable angles for the limbs of the L-shaped socket.

FIG. 12 shows a three-part (i.e., "triplet") corner structure 164" for two real and one virtual corner or edge according to a selected embodiment of the present invention which features L-shaped socket cross sections with selectable angles for the limbs of structure portions respectively 165, 168, and 268. Structure portion 165 includes first, second, and third surfaces 165*a*, 165*b*, and 165*c* respectively. Surfaces 165*c* and 165*a* have angled connections with surface 165*b* which according to one embodiment of the present invention are substantially equal in angular deviation from surface 165*b*. Structure portion 168 includes first, second, and third surfaces 168*a*, 168*b*, and 168*c* respectively. Surfaces 168*c* and 168*a* have angled connections with surface 168*b* which according to one embodiment of the present invention are substantially equal in angular deviation from surface 168*b*. Structure portion 268 includes first and second surfaces 268*a* and 268*b* which have a selected angular deviation from each other in terms of their respective planar surfaces. It is noted that any number of real corners may be so connected to a virtual corner or edge.

Figure 13:
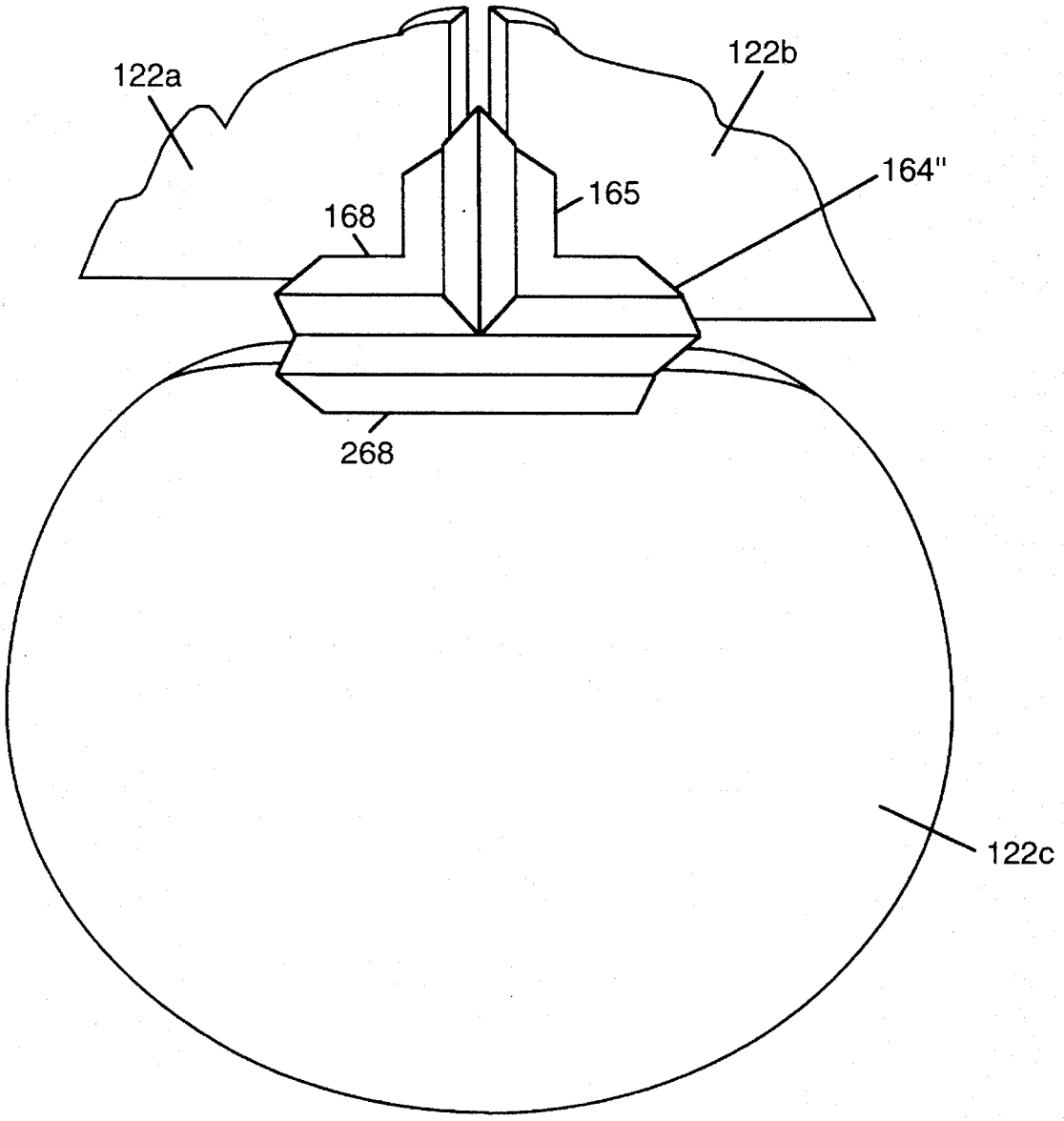
FIG. 13 shows first and second portions of cornered panels connected at adjacent corners at a three-part (i.e., "triplet") corner structure for two real and one virtual corner or edge according to a selected embodiment of the present invention featuring a third panel connected at a virtual corner or edge to the corner structure near the connection point of the first and second cornered panels.

FIG. 13 shows first and second portions of cornered panels 122*a* and 122*b*, connected at adjacent corners at a three-part (i.e., "triplet") corner structure 164" for two real and one virtual corner or edge according to a selected embodiment of the present invention. Third panel 122*c* is connected at a virtual corner or edge thereof to corner structure 164" near the connection point of the first and second cornered panels 122*a* and 122*b* with corner structure 164". It is noted that any number of real cornered panels may be so connected to another panel at its virtual corner or edge. As used herein, a virtual corner exists at the intersection of tangents along an edge, or edges, of a panel, or at a point or region proximal thereto in the vicinity of another corner, whether real or virtual, of a contiguous panel.

Figure 14:
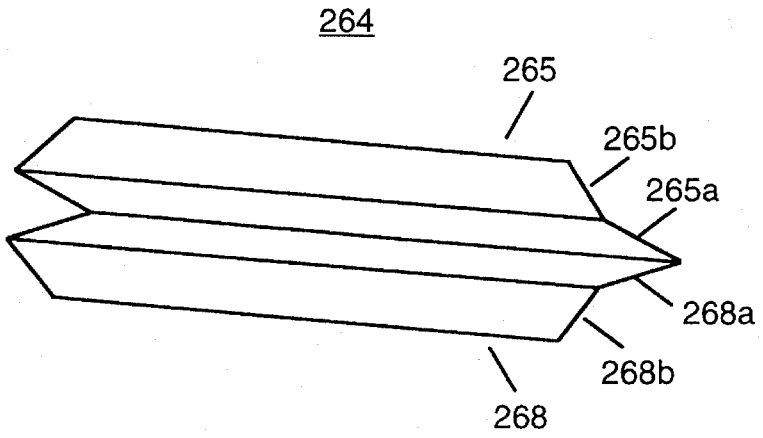
FIG. 14 shows a two-part (i.e., "doublet") corner or structure according to a selected embodiment of the present invention which features first and second L-shaped socket cross sections with selectable angles for the limbs of the socket cross-sectional L.

FIG. 14 shows a two-part (i.e., "doublet") corner structure 264 according to an embodiment of the present invention which features first and second L-shaped socket cross sections with selectable angles for the limbs of the L-shaped socket. Alternatively, corner structure 264 according to an embodiment of the present invention features first and second U- or J-shaped socket cross sections with selectable angles for the limbs of the associated socket cross-sections. Corner structure 264 includes structure portions 265 and 268. Structure portion 268 includes first and second surfaces 268*a* and 268*b* which have a selected angular deviation from each other in terms of their respective planar surfaces. Structure portion 265 includes first and second surfaces 265*a* and 265*b* which have a selected angular deviation from each other in terms of their respective planar surfaces. First surfaces 265*a* and 268*a* have a selected same or other angular deviation from each other in terms of their planar surfaces.

Figure 15:
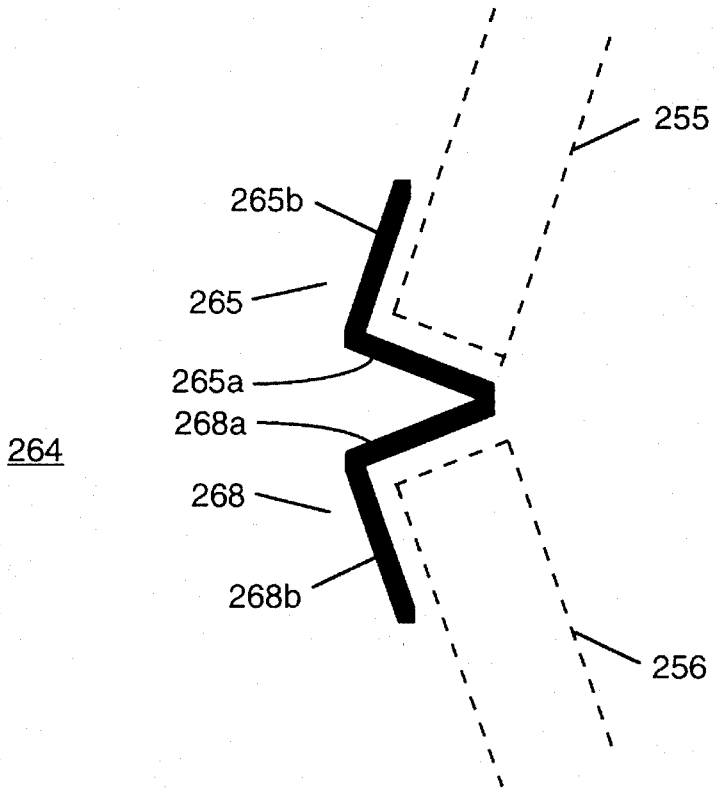
FIG. 15 shows a side cross-sectional view of the corner structure of FIG. 10, 11, 12, 13 or 14 emphasizing its L-shaped cross-sectional character, in a version connecting selected cantilevered ends of the first and second L-shaped socket cross sectional portions of the corner structure.

FIG. 15 shows a side cross-sectional view of corner structure 264 of FIG. 14 emphasizing its L-shaped cross-sectional character, in a version connecting selected cantilevered ends of the first and second L-shaped socket cross sectional portions 265 and 268 of corner structure 264. The cross sectional concept of FIG. 15 can also apply to the corner structures of FIGS. 10–13. Corner structure 264 is shown connected by adhesive or other attachment to panels 255 and 256 at real or virtual corners or edges or a combination thereof. Structure portion 268 includes first and second surfaces 268*a* and 268*b* which have a selected angular deviation from each other in terms of their respective planar surfaces. Structure portion 265 includes first and second surfaces 265*a* and 265*b* which have a selected angular deviation from each other in terms of their respective planar surfaces. Portions 265 or 268 can be J- or U-shaped rather than L-shaped to fit panels 255 and 256 at real or virtual corners or edges.

Figure 16:
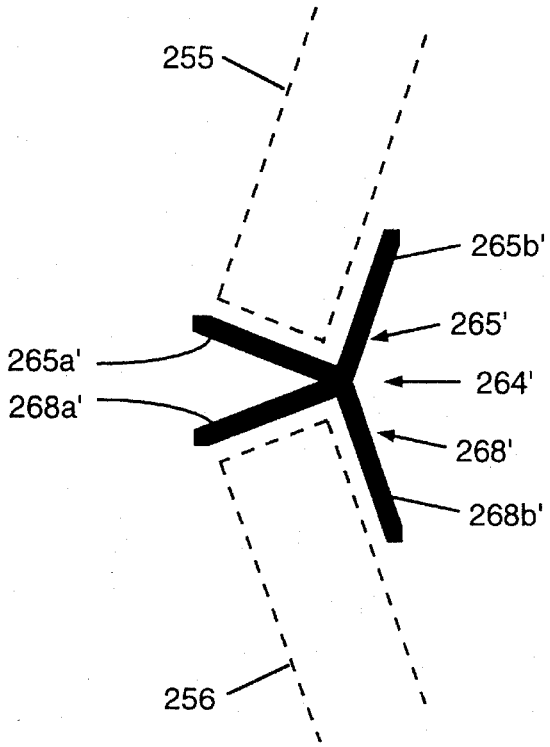
FIG. 16 shows a side cross-sectional view of the corner structure of FIG. 10, 11, 12, 13 or 14, in a version connecting the base ends of the first and second L-shaped socket cross sectional portions of the corner structure.

FIG. 16 shows a side cross-sectional view of the corner structure of FIG. 10, 11, 12, 13, or 14, i.e., corner structure 264', in an embodiment of the present invention connecting the base ends of the first and second L-shaped socket cross sectional structure portions 265' and 268'. Corner structure 264' is shown connected, as by adhesive or other attachment to panels 255 and 256 at real or virtual corners or edges or a combination thereof. Structure portion 268' includes first and second surfaces 268*a*' and 268*b*' which have a selected angular deviation from each other in terms of their respective planar surfaces. Structure portion 265'includes first and second surfaces 265*a*' and 265*b*' which have a selected angular deviation from each other in terms of their respective planar surfaces. Portions 265' or 268' can be J- or U-shaped rather than L-shaped to fit panels 255 and 256 at real or virtual corners or edges.

Figure 17:
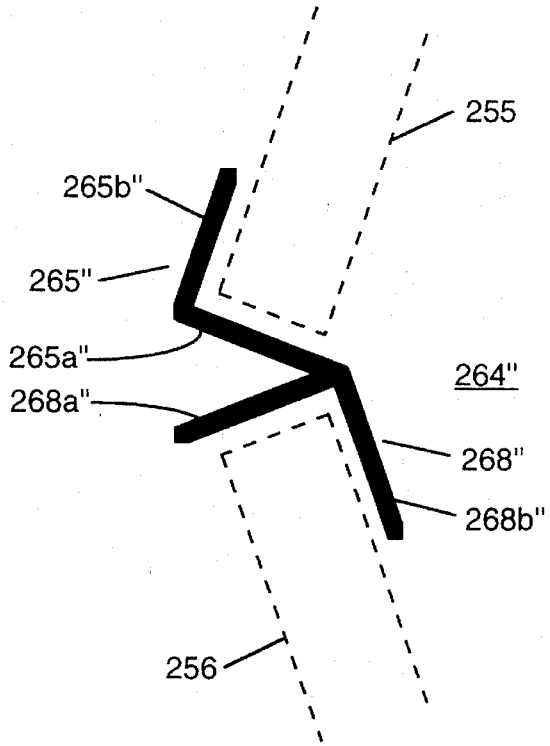
FIG. 17 shows a side cross-sectional view of the corner structure of FIG. 10, 11, 12, 13, or 14, in a version connecting a base end and a selected cantilevered end of respective first and second L-shaped socket cross sectional portions of the corner structure.

FIG. 17 shows a side cross-sectional view of the corner structure of FIG. 10, 11, 12, 13, or 14, i.e., corner structure 264", in an embodiment of the present invention connecting a base end and a selected cantilevered end of the first and second L-shaped socket cross sectional structure portions 265" and 268". Corner structure 264" is shown connected by adhesive or other attachment to panels 255 and 256 at real or virtual corners or edges or a combination thereof. Structure portion 268" includes first and second surfaces 268*a*" and 268*b*" which have a selected angular deviation from each other in terms of their respective planar surfaces. Structure portion 265" includes first and second surfaces 265*a*" and 265*b*" which have a selected angular deviation from each other in terms of their respective planar surfaces. Portions 265" or 268" can be J- or U-shaped rather than L-shaped to fit panels 255 and 256 at real or virtual corners or edges.

Figure 18:
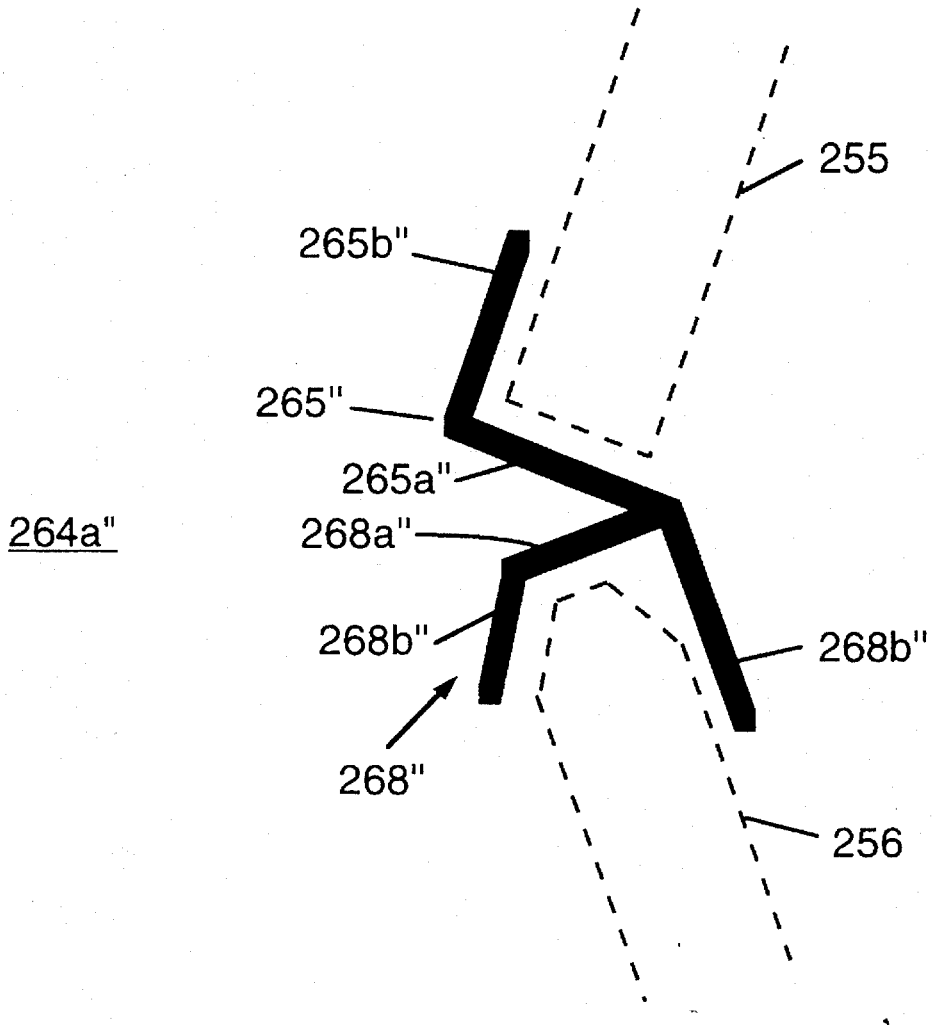
FIG. 18 shows a side cross-sectional view of the corner structure of FIG. 10, 11, 12, 13, or 14, in a version connecting a base end and a selected cantilevered end of respective J-shaped and L-shaped socket cross sectional portions of the corner structure.

FIG. 18 shows a side cross-sectional view of the corner structure of FIG. 10, 11, 12, 13, or 14, i.e., corner structure 264*a*", in an embodiment of the present invention connecting a base end and a selected cantilevered end of respective J-shaped and L-shaped socket cross sectional structure portions 265" and 268". Corner structure 264*a*" is shown connected, as by glue or adhesive, for example and without limitation, to panels 255 and 256 at real or virtual corners or edges or a combination thereof. Structure portion 268" includes first and second surfaces 268*a*" and 268*b*" which have a selected angular deviation from each other in terms of their respective planar surfaces. Structure portion 265" includes first and second surfaces 265*a*" and 265*b*" which have a selected angular deviation from each other in terms of their respective planar surfaces. Portions can be L- or U-shaped or J-shaped to fit panels 255 and 256 at real or virtual corners or edges.

Figure 19:
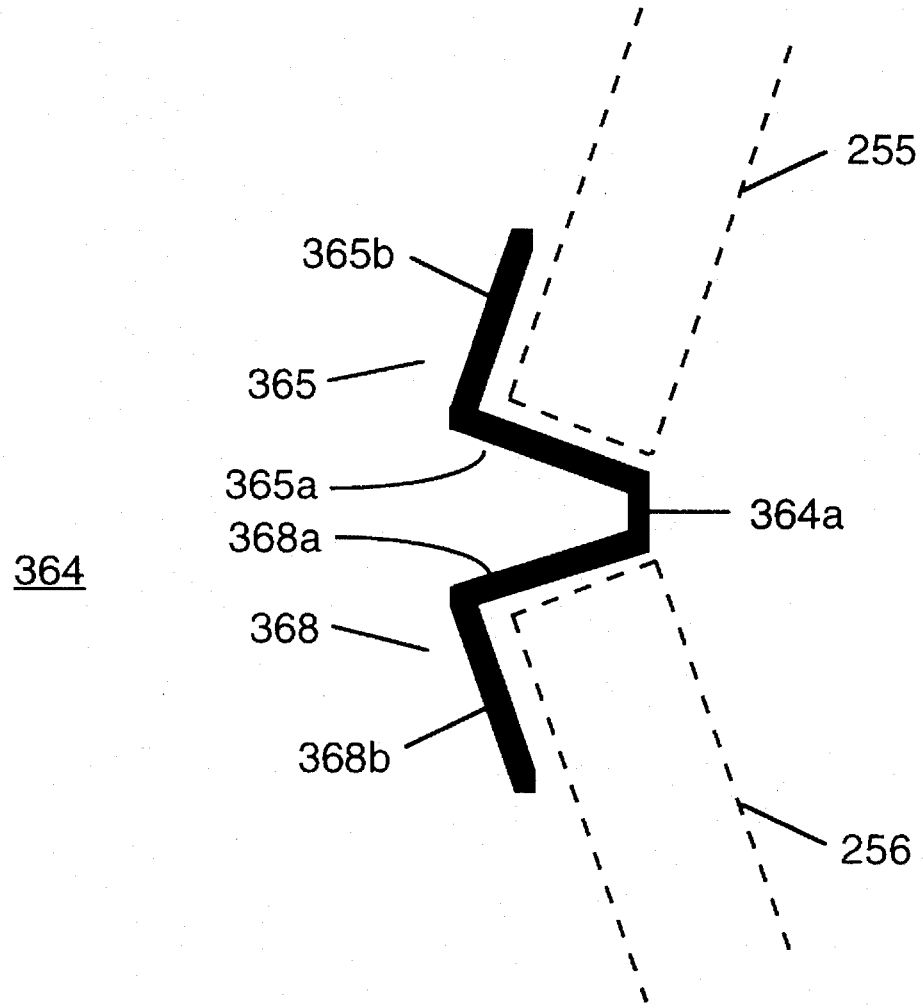
FIG. 19 shows a side cross-sectional view of the corner structure of FIG. 10, 11, 12, 13, or 14 emphasizing its L-shaped cross-sectional character, in a version connecting selected cantilevered ends of the first and second L-shaped socket cross sectional portions of the corner structure with an extension piece of substantial width and having the cantilevered ends of the first and second L-Shaped socket cross sectional portions in relative proximity compared with the base ends.

FIG. 19 shows a side cross-sectional view of corner structure 364 of FIG. 10, 11, 12, 13, or 14 emphasizing its L-shaped cross-sectional character, in a version connecting selected cantilevered ends of the first and second L-shaped socket cross sectional portions 365 and 368 of corner structure 364 with an extension piece 364*a* of substantial width and having the cantilevered ends of the first and second L-shaped socket cross sectional portions 365 and 368 in relative proximity as compared to the base ends. Corner structure 364 is shown connected by adhesive or other attachment to panels 255 and 256 at real or virtual corners or edges or a combination thereof. Structure portion 368 includes first and second surfaces 368*a* and 368*b* which have a selected angular deviation from each other in terms of their respective planar surfaces. Structure portion 365 includes first and second surfaces 365*a* and 365*b* which have a selected angular deviation from each other in terms of their respective planar surfaces. Portions 365 or 368 can be J- or U-shaped rather than L-shaped to fit panels 255 and 256 at real or virtual corners or edges.

Figure 20:
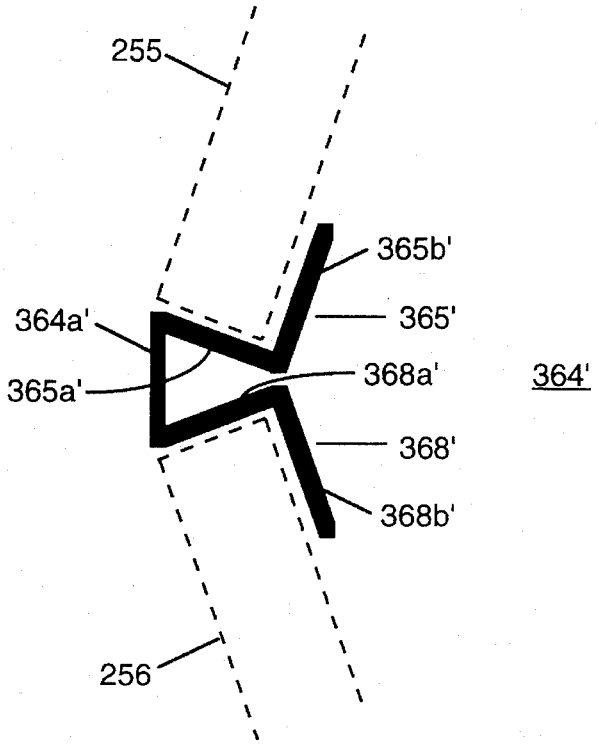
FIG. 20 shows a side cross-sectional view of the corner structure of FIG. 10, 11, 12, 13, or 14, in a version connecting selected cantilevered ends of the first and second L-shaped socket cross sectional portions of the corner structure with an extension piece of substantial width and having the base ends of the first and second L-shaped socket cross sectional portions in relative proximity compared with the cantilevered ends.

FIG. 20 shows a side cross-sectional view of the corner structure of FIG. 10, 11, 12, 13, or 14, i.e., corner structure 364', in an embodiment of the present invention connecting selected cantilevered ends of the first and second L-shaped socket cross sectional portions 365' and 368' of the corner structure with an extension piece of substantial width and having the base ends of the first and second L-shaped socket cross sectional portions 365' and 368' in relative proximity as compared to the cantilevered ends. Corner structure 364' is shown connected by adhesive or other attachment to panels 255 and 256 at real or virtual corners or edges or a combination thereof. Structure portion 368' includes first and second surfaces 368*a*' and 368*b*' which have a selected angular deviation from each other in terms of their respective planar surfaces. Structure portion 365' includes first and second surfaces 365*a*' and 365*b*' which have a selected angular deviation from each other in terms of their respective planar surfaces. Portions 365' or 368' can be J- or U-shaped rather than L-shaped to fit panels 255 and 256 at real or virtual corners or edges.

Figure 21:
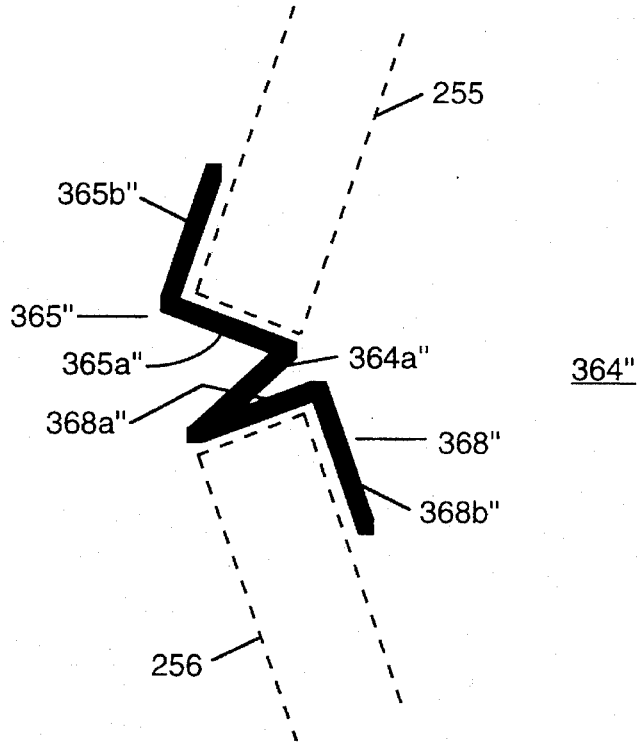
FIG. 21 shows a side cross-sectional view of the corner structure of FIG. 10, 11, 12, 13, or 14, in a version connecting selected cantilevered ends of respective first and second L-shaped socket cross sectional portions of the corner structure with an extension piece of substantial width to the cantilevered ends while maintaining the base of one L-shaped socket closer to the cantilevered end of the other L-shaped socket than to the base of the other L-shaped socket.

FIG. 21 shows a side cross-sectional view of the structure of FIG. 10, 11, 12, 13, or 14, i.e., corner structure 364", in an embodiment of the present invention connecting selected cantilevered ends of respective first and second L-shaped socket cross sectional portions of the corner structure with an extension piece of substantial width to the cantilevered ends while maintaining the base of one L-shaped socket closer to the cantilevered end of the other L-shaped socket than to the base of the other L-shaped socket. Corner structure 364" is shown cooperatively connected by adhesive or other attachment to panels 255 and 256 at real or virtual corners or edges or a combination thereof. Structure portion 368" includes first and second surfaces 368*a*" and 368*b*" which have a selected angular deviation from each other in terms of their respective planar surfaces. Structure portion 365" includes first and second surfaces 365*a*" and 365*b*" which have a selected angular deviation from each other in terms of their respective planar surfaces. Portions 365" or 368" can be J- or U-shaped rather than L-shaped to fit panels 255 and 256 at real or virtual corners or edges.

Figure 22:
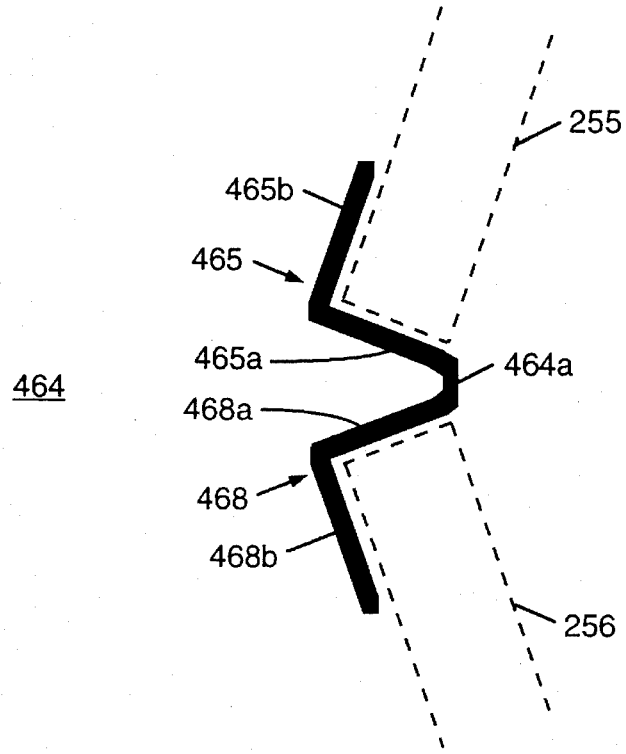
FIG. 22 shows a side cross-sectional view of the corner structure of FIG. 10, 11, 12, 13, or 14 emphasizing its L-shaped cross-sectional character, in a version connecting selected cantilevered ends of the first and second L-shaped socket cross sectional portions of the corner structure with a rounded extension piece of substantial width and having the cantilevered ends of the first and second socket portions in relative proximity compared with the base ends.

FIG. 22 shows a side cross-sectional view of corner structure 464 of FIG. 10, 11, 12, 13, or 14 emphasizing its L-shaped cross-sectional character, in a version connecting selected cantilevered ends of the first and second L-shaped socket cross sectional portions 465 and 468 of corner structure 464 with a rounded extension piece 464*a* of substantial width and having the cantilevered ends of the First and Second socket portions 465 and 468 in relative proximity as compared to the base ends. Corner structure 464 is shown connected by adhesive or other attachment to panels 255 and 256 at real or virtual corners or edges or a combination thereof. Structure portion 468 includes first and second surfaces 468*a* and 468*b* which have a selected angular deviation from each other in terms of their respective planar surfaces. Structure portion 465 includes first and second surfaces 465*a* and 465*b* which have a selected angular deviation from each other in terms of their respective planar surfaces. Portions 465 or 468 can be J- or U-shaped rather than L-shaped to fit panels 255 and 256 at real or virtual corners or edges.

Figure 23:
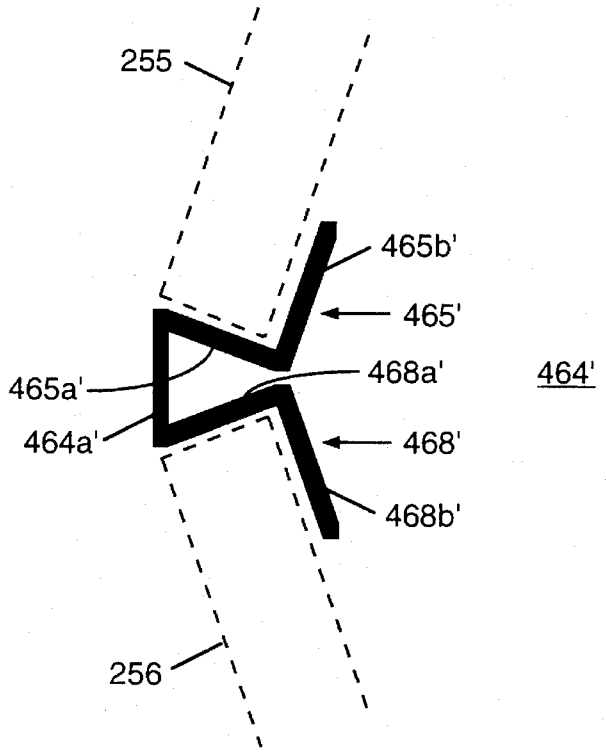
FIG. 23 shows a side cross-sectional view of the corner structure of FIG. 10, 11, 12, 13, or 14, in a version connecting selected cantilevered ends of the first and second socket portions of the corner structure with an extension piece of substantial width connected to the cantilevered ends with a markedly rounded connection surface and having the base ends of the first and second socket portions in relative proximity compared with the cantilevered ends.

FIG. 23 shows a side cross-sectional view of the corner structure of FIG. 10, 11, 12, 13, or 14, i.e., corner structure 464', in an embodiment of the present invention connecting selected cantilevered ends of the first and second socket structure portions 465' and 468' with an extension piece of substantial width with a markedly rounded connection surface and having the base ends of the first and second portions 465' and 468' in relative proximity as compared to the cantilevered ends. Corner structure 464' is shown connected by adhesive or other attachment to panels 255 and 256 at real or virtual corners or edges or a combination thereof. Structure portion 468' includes first and second surfaces 468*a'* and 468*b'* which have a selected angular deviation from each other in terms of their respective planar surfaces. Structure portion 465' includes first and second surfaces 465*a'* and 465*b'* which have a selected angular deviation from each other in terms of their respective planar surfaces. Portions 465' or 468' can be J- or U-shaped rather than L-shaped to fit panels 255 and 256 at real or virtual corners or edges.

Figure 24:
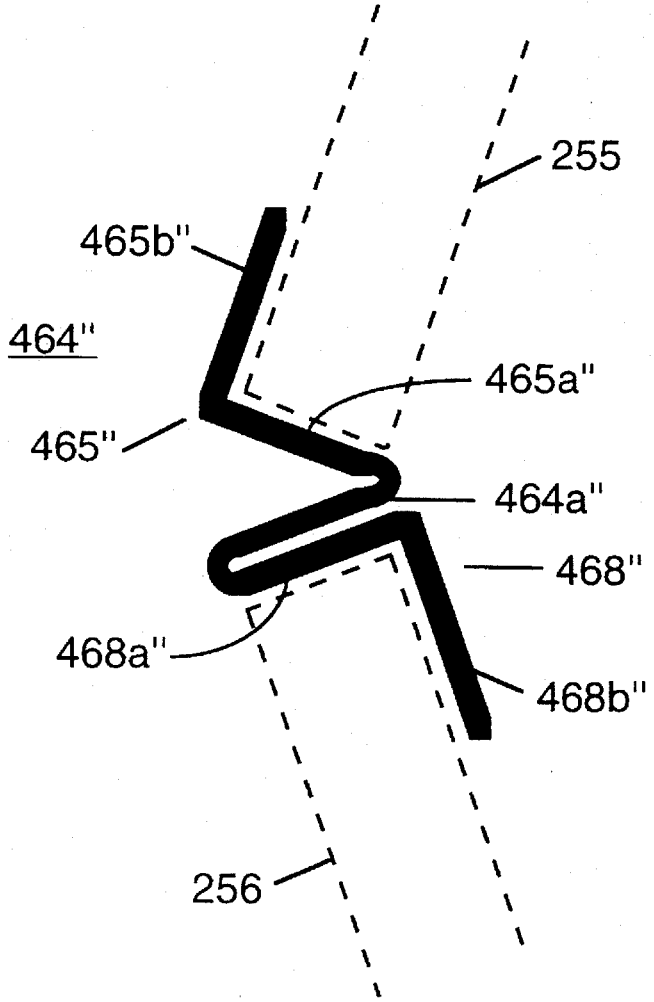
FIG. 24 shows a side cross-sectional view of the corner structure of FIG. 10, 11, 12, 13, or 14, in a version connecting selected cantilevered ends of respective first and second socket portions of the corner structure with an extension piece of substantial width and connected at rounded surfaces to the cantilevered ends while maintaining the base of one L-shaped socket closer to the cantilevered end of the other L-shaped socket than to the base of the other L-shaped socket.

FIG. 24 shows a side cross-sectional view of the corner structure of FIG. 10, 11, 12, 13, or 14, i.e., corner structure 464", in an embodiment of the present invention connecting selected cantilevered ends of respective first and second portions 465" and 468" of the corner structure with an extension piece of substantial width and connected at rounded surfaces to the cantilevered ends while maintaining the base of one L-shaped socket closer to the cantilevered end of the other L-shaped socket than to the base end of the other L-shaped socket. Corner structure 464" is shown connected by adhesive or other attachment to panels 255 and 256 at real or virtual corners or edges or a combination thereof. Structure portion 468" includes first and second surfaces 468*a"* and 468*b"* which have a selected angular deviation from each other in terms of their respective planar surfaces. Structure portion 465" includes first and second surfaces 465*a"* and 465*b"* which have a selected angular deviation from each other in terms of their respective planar surfaces. Portions 465" or 468" can be J- or U-shaped rather than L-shaped to fit panels 255 and 256 at real or virtual corners or edges.

In each of the embodiments illustrated or described herein, it should be noted that 'horizontal' and 'vertical' references are for convenience in describing a generally descending structure of attached panels, and that such references throughout should be considered applicable, though oriented by 90° angular displacement (or any other suitable angle), to similar structures of attached panels disposed to be attached to a vertical or tilted wall or ceiling. In addition, it should be noted that tier-by-tier construction illustrated or described herein in generally horizontal orientations is also applicable to construction of vertically oriented segments which are connected together to form larger vertical segments which are then connected together to form the complete structure. Additionally, it should be noted that tiers, as used herein, includes linearly as well as randomly or irregularly arranged and sized adjacent or contiguous panels. Further, the corner structure constructions shown in FIGS. 10 et seq. permit convenient stamping from sheet metal.

What is claimed is:

1. A lighting structure comprising:

first and second panels of selected optical and physical properties, each of the first and second panels having at least one edge;

a corner structure for coupling said first and second panels to each other at a predetermined angle, said corner structure including first and second sockets of which at least one of said first and second sockets includes a single whole flange member and at most one partial flange member for connection to one of said first and second panels;

an adhesive for attaching the first and second panels to the corner structure;

and wherein one of said first and second panels includes a virtual corner connected to the other of said first and second panels at a corner via said corner structure.

* * * * *